US005263710A

United States Patent [19]

Blumer et al.

[11] Patent Number: 5,263,710

[45] Date of Patent: Nov. 23, 1993

[54] ANCHORING DEVICE FOR AN OBJECT

[76] Inventors: David S. Blumer, 132 Sheppard Ave. West Suite 200, North York, Ontario, Canada, M2N 1M5; Henry Hendriks, 221 Milvan Drive, Weston, Ontario, Canada, M9L 2A3

[21] Appl. No.: 925,171

[22] Filed: Aug. 6, 1992

[51] Int. Cl.[5] ..... A63B 71/00

[52] U.S. Cl. ..... 273/25

[58] Field of Search ..... 273/25; 135/118; 119/121; D30/154

[56] References Cited

U.S. PATENT DOCUMENTS

| | | | |
|---|---|---|---|
| 249,904 | 11/1881 | Covert | 119/221 |
| 657,263 | 9/1900 | Bunje | 119/221 |
| 2,046,126 | 6/1936 | Latina | 273/25 |
| 2,103,148 | 12/1937 | Conrad | 273/25 |
| 2,220,142 | 11/1940 | Braxton | 273/25 |
| 2,471,736 | 5/1949 | Fleming et al. | 273/25 |
| 2,941,504 | 6/1961 | Supowitz | 119/221 |
| 2,956,543 | 10/1960 | Kirk | 119/221 |
| 3,658,037 | 4/1972 | Hunter | 119/221 |
| 4,915,383 | 4/1990 | Yamakuchi | 273/25 |

FOREIGN PATENT DOCUMENTS

| | | | |
|---|---|---|---|
| 433613 | 9/1926 | Fed. Rep. of Germany | 119/221 |
| 129124 | 8/1950 | Sweden | 119/221 |
| 15811 | of 1909 | United Kingdom . | |
| 193004 | 11/1924 | United Kingdom | 119/221 |

*Primary Examiner*—Theatrice Brown

*Attorney, Agent, or Firm*—Ivor M. Hughes; Neil H. Hughes

[57] ABSTRACT

An anchoring device and baseball base combination, wherein the anchor device is a peg having a lower end for insertion into the ground and an upper end having a curved opening, which engage an integral closed loop which receives a strap connected to the baseball base for securing the baseball base to the ground.

6 Claims, 5 Drawing Sheets

ANCHORING DEVICE FOR AN OBJECT

FIELD OF THE INVENTION

The present invention relates to an anchoring device for an object, and more particularly to an anchoring device for securing a baseball base to the ground.

BACKGROUND OF THE INVENTION

In the game of baseball and similar games a player is required to run and touch a base, after striking a ball with a bat. The anchoring device used in the ground is a major concern to the players. Known base anchoring devices are generally rigid or unmovable causing injuries to players for example when a player steals a base or slides into a base. There have been several attempts to make a variety of base anchoring assemblies with limited movement to minimize injuries to the players.

Examples of various anchoring systems are disclosed in U.S. Pat. Nos. 1,268,459, 4,398,714, 4,060,244 and 4,915,383. These prior art assemblies for anchoring a baseball base provide generally a main rod portion having an enlarged driving end portion at the top, and a lower pointed portion which is drive into the ground. The base is fastened with an attached strap to the assembly to prevent the base from rotating or moving. However, the drawbacks associated with these types of assemblies are their inability to move, for example rotate, and the large exposed obstacle they present at the driving head portion which increases the likelihood of injury to the participants of the game of baseball.

Nowhere within the prior art is there found an anchoring device which lies flat in use and will yield to a player when sliding into the base.

Therefore, the need exists for a yieldable anchoring mechanism to minimize the amount of injuries to players resulting from running the bases.

It is therefore a primary object of this invention to provide an anchoring device for an object which yields to human contact to prevent injury of the contacting person, yet retains the object anchored generally in its required position.

It is a further objects of this invention to provide an anchoring device which is easy to use and less cumbersome.

Further and other object of the invention will become apparent to those skilled in the art when considering the full summary of the invention and the more detailed description of the preferred embodiments illustrated herein.

SUMMARY OF THE INVENTION

According to one aspect of the invention there is provided an anchoring assembly (for example, a peg with continuous loop attachment manufactured from zinc plated steel) for securing an object (for example a baseball base) to the ground at a selected position, the assembly comprising a peg having two ends and having an opening disposed proximate the upper end thereof and preferably extending in a direction substantially transverse to the direction of the extension of the peg, (in one embodiment the upper end preferably presenting a curved loop), a closed loop of material (preferably also manufactured from zinc plated steel), being moveably engaged with the upper end of the peg through the opening thereof (preferably the closed loop passes through the opening in the upper end of the peg) and being moveable, for example being able to swivel and rotate, with respect to the upper end of the peg, preferably the closed loop being of such width to permit a securing strap of an object (for example a base) to pass through the closed loop preferably without extensive distortion, wherein when a person (for example a baseball player) aggressively engages the object (for example sliding into the base), the object (for example the base) is free to move, for example swivel and rotate, with the closed loop proximate the upper end of the peg opening, preventing injury to the person (e.g. baseball player).

In a preferred embodiment, the anchoring assembly may further comprise a peg having a loop at the top end thereof wherein the body of the closed loop is triangular in shape or the like. Other geometrical shapes providing the same advantages and performance can be used.

An anchoring mechanism for anchoring a baseball base, including a securing strap, to the ground comprising a peg having two ends, one end adapted for driving into the ground, the other end adapted to allow the peg to be driven into the ground, and for engagement with the strap via a supplementary loop member which is moveably engaged in use with respect to the driven end of the peg, the baseball base in use being engaged with the ground and secured thereto via the strap thereof engaged with the supplementary loop member, the loop being oriented generally in a direction from which a force will be exerted so as to allow movement of the base when impacted, wherein the closed loop and base secured thereto in moving when subjected to the force of a player's foot or body will reduce the risk of injury to the player.

In yet another preferred embodiment there is provided an anchoring assembly comprising a peg having a loop at the top end thereof wherein the body of the closed loop is generally a flat body member substantially elliptical in shape or the like.

In yet another preferred embodiment there is provided the use of anchoring assembly for securing a baseball base to the ground at selected position, the assembly comprising a peg having two ends and having an opening disposed proximate the upper end thereof and preferably extending in a direction substantially transverse to the direction of the extension of the peg, a closed loop of material being moveably engaged with the upper end of the peg through the opening thereof and being moveable, for example being able to swivel and rotate, with respect to the upper end of the peg, preferably the closed loop being of such width to permit a securing strap of a base to pass through the closed loop without extensive distortion, wherein when a baseball player aggressively engages the base, the base is free to move, for example swivel and rotate, with the closed loop proximate the upper end of the peg opening, preventing injury to the baseball player.

In yet another preferred embodiment there is provided a method of securing a baseball base including a securing strap to the ground at selected position incorporating an anchoring assembly, the assembly comprising a peg having two ends, one end adapted for driving into the ground, the other end adapted to allow the peg to be driven into the ground, and for engagement with the strap via a supplementary loop member which is moveably engaged in use with respect to the driven end of the peg, the loop being oriented generally in a direction from which a force will be exerted so as to allow movement of the base when impacted the steps comprising: (a) driving the end adapted for driving into the ground, into the ground, and (b) engaging the securing strap to the supplementary loop member and to the baseball base.

BRIEF DESCRIPTION OF THE DRAWINGS

The invention will now be illustrated with reference to the following drawings in which.

DETAILED DESCRIPTION OF PREFERRED EMBODIMENTS OF THE INVENTION

Figure 1:
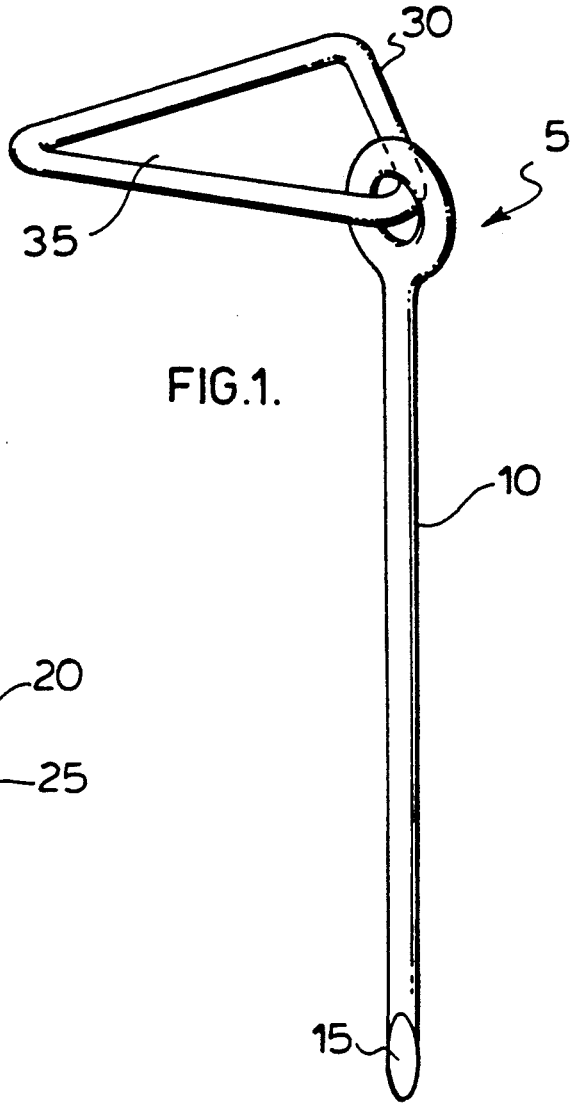
FIG. 1 is a perspective view of the peg assembly of the present invention illustrated in a preferred embodiment.
Figure 2:
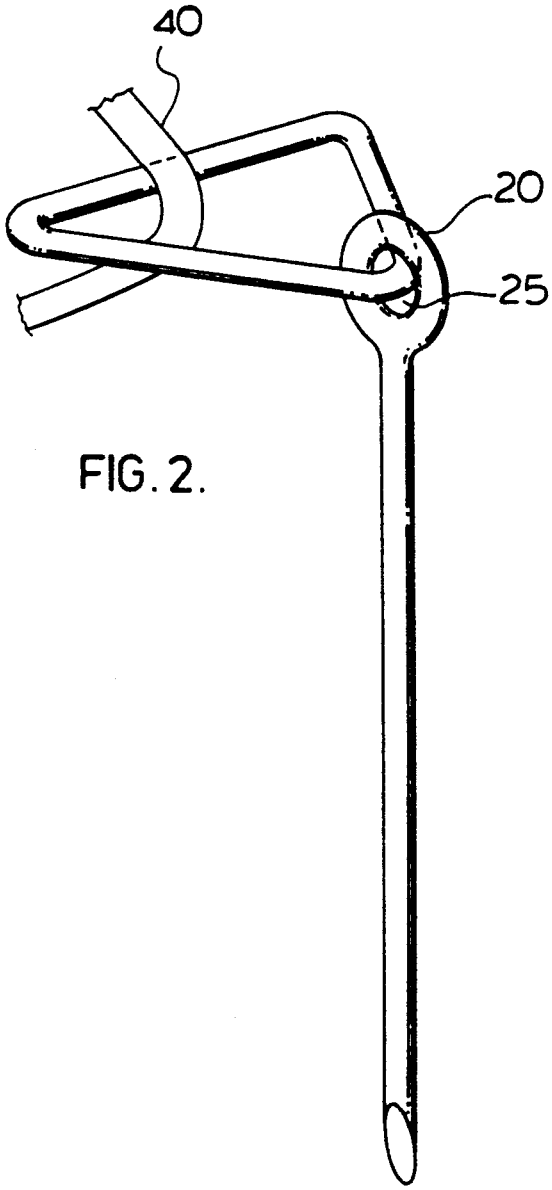
FIG. 2 shows the use of the peg illustrated in a preferred embodiment of the invention.
Figure 3:
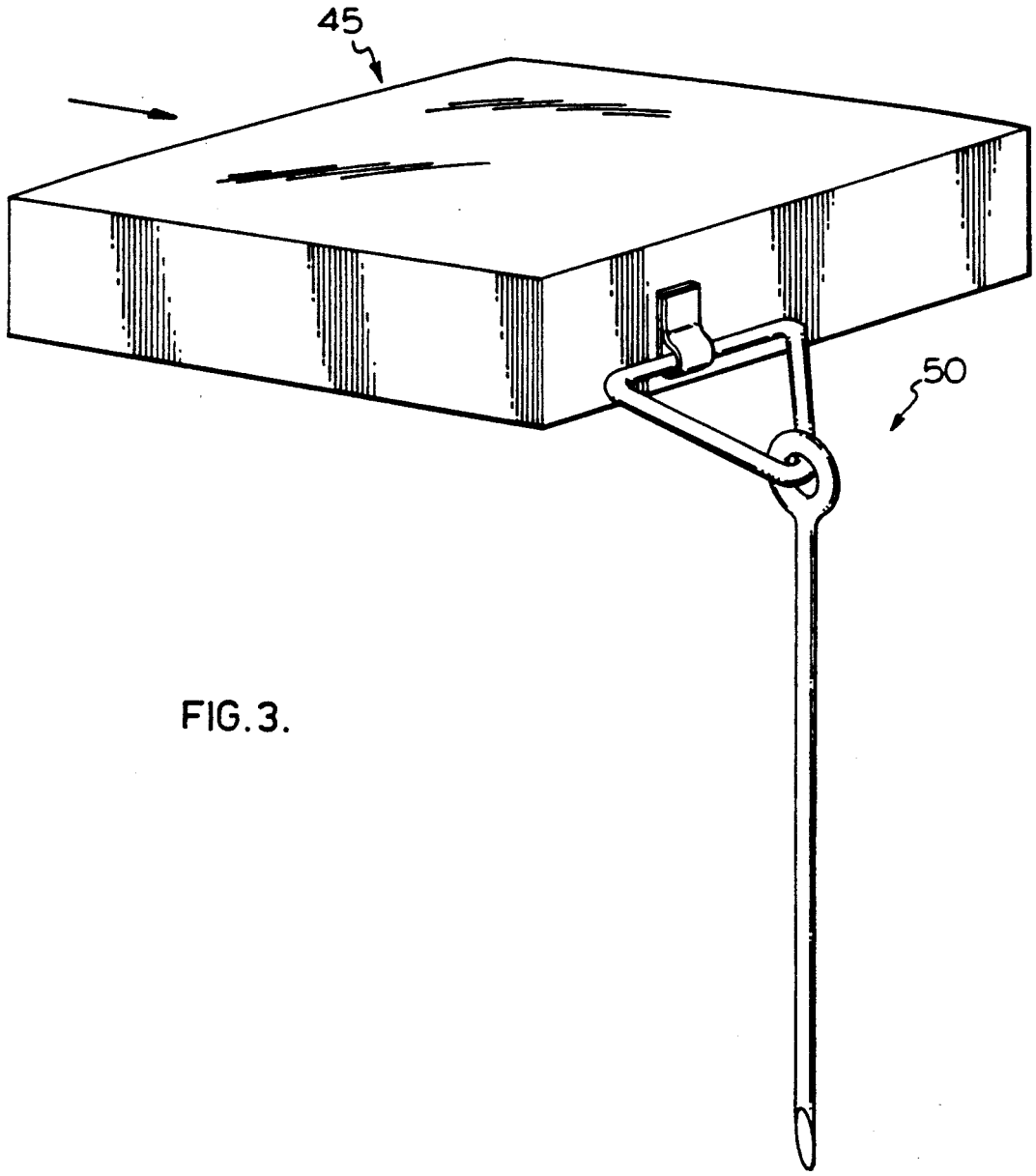
FIG. 3 shows the use of the structure of FIG. 2 for securing of a baseball base.

Referring now to the drawings, the assembly of the present invention is indicated generally at 5; and is shown in FIG. 1 comprising an elongated peg 10 having a flat pointed lower end portion 15 to facilitate driving of the peg 10 when struck with a hammer or the like into the ground 50 such that the upper end loop 20 is slightly below the level of the ground 50. The upper end loop 20 has an opening 25 for the passage of a closed loop 30 having a further opening 35. Referring now to FIG. 2, the opening 35 receives a strap 40 to fasten and draw the side portion of base 45 down to the ground 50 as shown in FIG. 3. It is important to note that when the elongated peg 10 is driven into the ground 50, the body of the closed loop 30 is substantially out of contact with the ground 50, thus providing a convenient means by which said elongated peg 10 may be pulled from the ground 50 when there is a need to remove the secured base 45 from a selected position as well as to allow movement of the closed loop 30 in relation to the upper end loop 20. The closed loop 30 is preferably triangular in shape although other geometrical shapes may be used, when they provide the same desired results.

Figure 4:
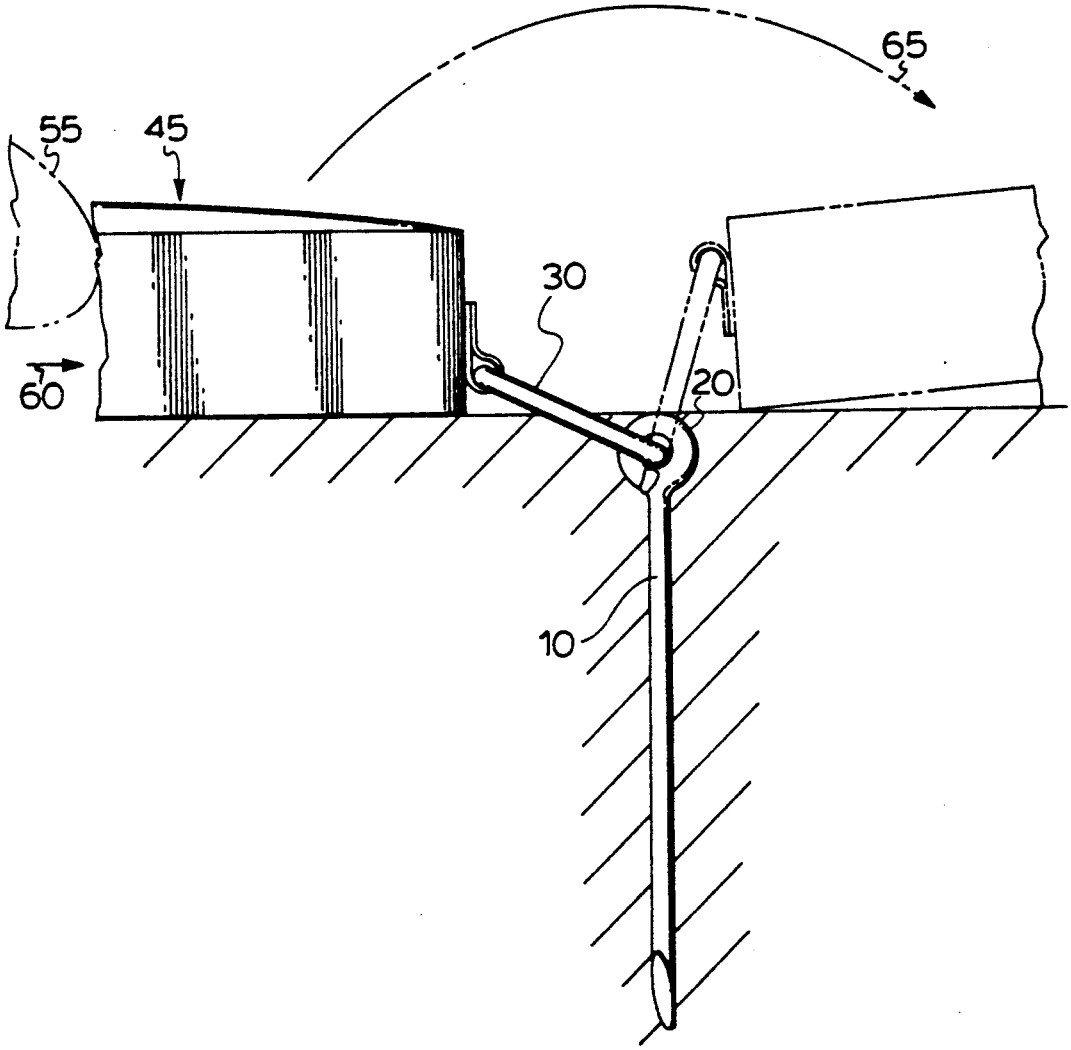
FIGS. 4, 5, and 5*a* depicts the impact of the player against a base illustrated in a preferred embodiment of the invention.
Figure 5:
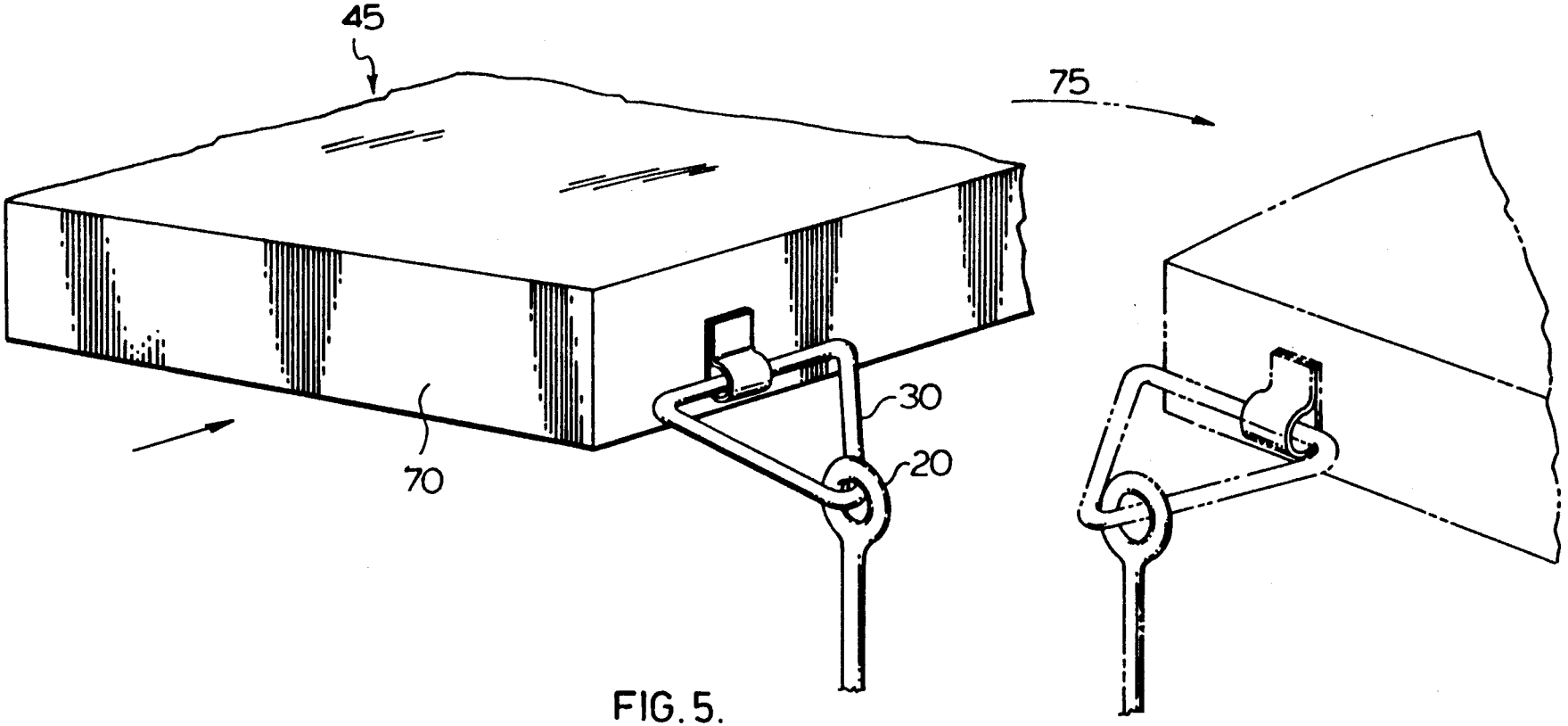
Figure 5A:
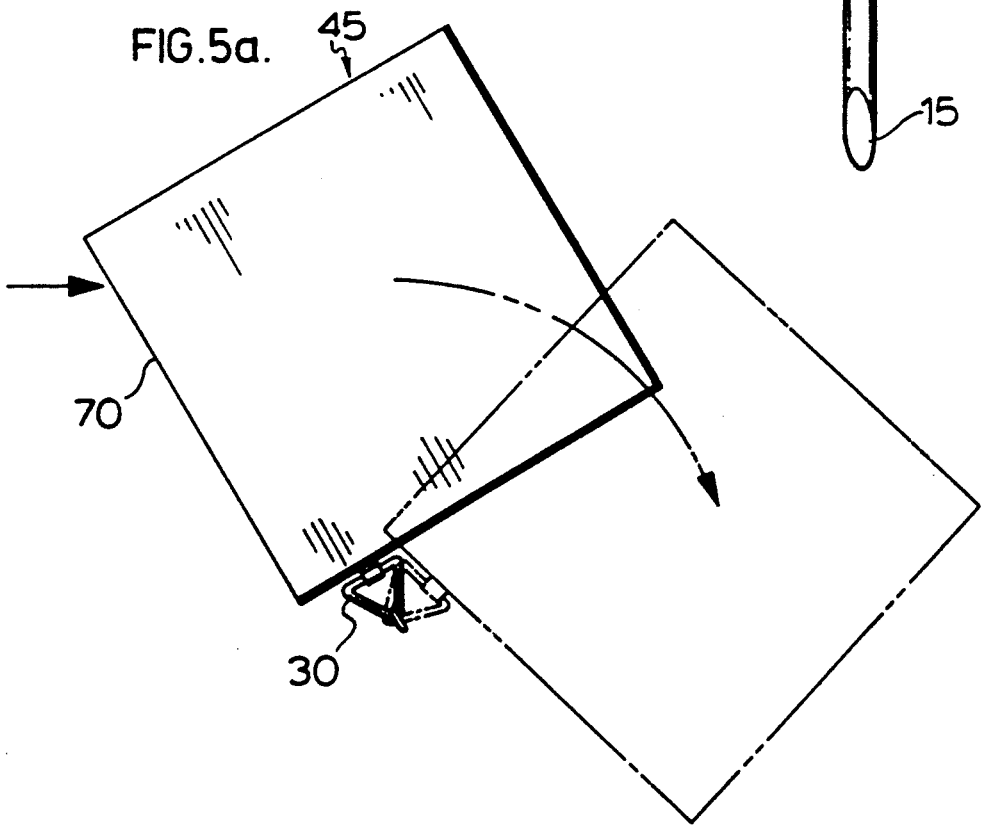

Thus, in use, when the player or fielder 55 runs and impacts the base 45 in the direction 60, the closed loop 30 will rotate with respect to the upper end loop 20 of the peg 10 in the direction of 65 proximate the upper end of the opening 25. When side 70 of the base 45 is subjected to a sufficient impact by player 55, the closed loop 30 will swivel in the direction 75 with respect to the upper end loop 20 as shown in FIGS. 5 and 5*a*. It is important to note that the closed loop 30 is positioned in the direction of the base 45, in the manner shown in FIG. 3, to keep the said base 45 in operative position such that the closed loop 30 may rotate or swivel with respect to the upper end loop 20 of the peg 10 in the directions of 65 or 75 of FIGS. 4 and 5 respectively. After rotating or swiveling of the said closed loop 30 in the indicated direction, the closed loop 30 is put back into its original and operative position of FIG. 3 such that the base 45 is at the originally selected position.

Figure 6:
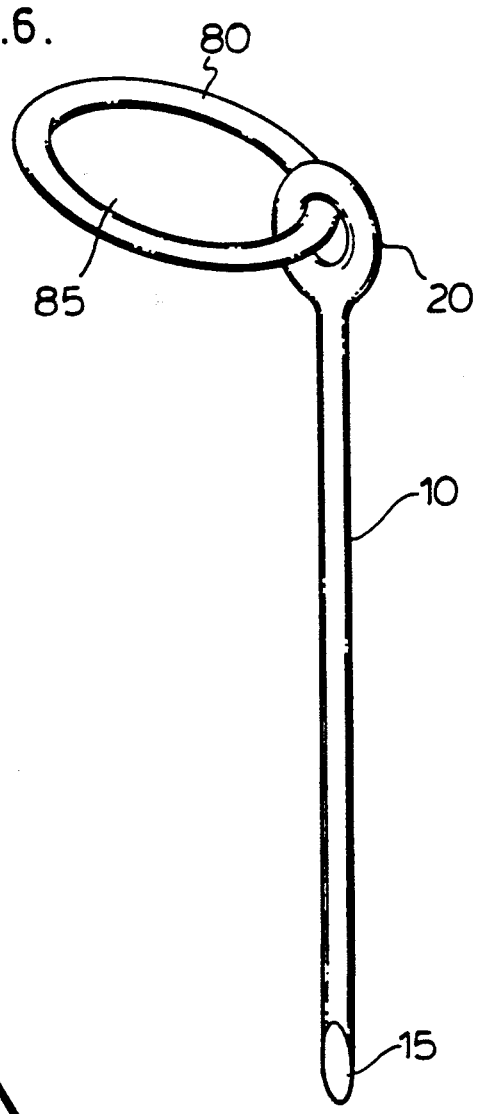
FIG. 6 illustrates a body of a closed loop which may be used for connecting with the peg.

Referring to FIG. 6, the anchoring assembly 5 of the present invention may further comprise a closed loop member 80 having an opening 85, where the closed loop 80 is substantially elliptical in shape. The opening 85 receives a strap 40 fastened to a base 45 and connect to the upper end loop 20 as shown and described in FIG. 2. Injuries to the player relating to the fixed position of bases as shown in the prior art is thus avoided.

As will be apparent to those skilled in the art, various modifications and adaptations of the structure described above may be made without departing from the scope or spirit of the invention; the limitation of the scope of the embodiment of the invention are to be construed in accordance with the accompanying claims and not in a limiting sense.

The embodiments of the invention in which an exclusive property or privilege is claimed are as follows:

1. In combination, a baseball base and an anchoring assembly for securing said baseball base to the ground at a selected position, the base having securing means for securing said base to the anchor assembly, said anchoring assembly comprising, a peg having two ends an upper end and a lower end, the lower end being adapted to be driven into the ground, the upper end having an opening; a closed loop of material extending through said opening and being moveably engaged with the upper end of the peg through said opening thereof and being moveable with respect to the upper end of the peg, the closed loop for being removably secured to the securing means and movable relative to said base wherein when a person aggressively engages the base, the base is free to slide and rotate to thereby decrease possible injury to the person engaging the baseball base.

2. The anchoring assembly of claim 1 wherein said opening is extended in a direction substantially transverse to the direction of the extension of the peg.

3. The combination baseball base and anchoring assembly of claim 1 or 2 wherein said opening is a curved loop.

4. The combination baseball base and anchoring assembly system of claim 1 wherein said closed loop is triangular.

5. The combination baseball base and anchoring assembly system of claim 1 wherein said securing means is a strap and the closed loop is of such width to permit said strap to pass through the closed loop without distortion.

6. The combination baseball base and anchoring assembly system of claim 1 or 5 wherein said closed loop has a substantially elliptical ring shape.

* * * * *